US006174209B1

(12) United States Patent
Cooper

(10) Patent No.: US 6,174,209 B1
(45) Date of Patent: Jan. 16, 2001

(54) AMPHIBIOUS ROBOT MINE LOCATOR

(75) Inventor: Guy Frank Cooper, Ventura, CA (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/449,991

(22) Filed: Nov. 26, 1999

(51) Int. Cl.[7] ..... B60F 3/00

(52) U.S. Cl. ..... 440/12.5; 114/312; 114/313; 114/315; 440/12.66

(58) Field of Search ..... 114/312, 313, 114/315, 337, 338; 440/12.5, 12.66–12.7

(56) References Cited

U.S. PATENT DOCUMENTS

| | | | | |
|---|---|---|---|---|
| 3,434,443 | * | 3/1969 | Estabrook | 114/315 |
| 3,442,240 | * | 5/1969 | Wild et al. | 114/315 |
| 3,946,696 | * | 3/1976 | Lubnow | 114/221 R |
| 4,185,326 | * | 1/1980 | Whittaker | 367/96 |
| 4,200,922 | * | 4/1980 | Hagemann | 367/96 |
| 4,565,487 | * | 1/1986 | Kroczynski | 414/730 |

FOREIGN PATENT DOCUMENTS 34 30 498 * 6/1998 (DE) .

* cited by examiner

*Primary Examiner*—Sherman Basinger
(74) *Attorney, Agent, or Firm*—David Kalmbaugh

(57) ABSTRACT

The amphibious robot mine locator may be used in water-based and land-based environments to locate mines and other hazards. In a water-based environment a diver controls movement of the amphibious robot mine locator. In a land-based environment movement of the mine locator is via remote control. Mine locator includes a pair of oppositely rotating propellers which propel the mine locator through the water with a ruder being provided to control the direction of movement of amphibious robot mine locator as it travels through the water. There is also a control panel which includes the controls for allowing the diver to steer amphibious robot mine locator and control the depth of mine locator. When amphibious robot mine locator switches to a land-based mode of operation, the propellers function as wheels rotating in the same direction to move amphibious robot mine locator along a programmed path to continue its search for mines and other obstacles and hazards. The amphibious robot mine locator also has a pair of air operated pulsating blisters which allow for essentially frictionless movement across the grounds surface irregardless of the shape of the surface. Each blister has a contact surface located on its underside which is fabricated from a material which is flexible and has a hard surface that will not scratch, such as Teflon. The flexibility of the contact surface of each blister allows the blister to travel over irregular shaped objects such as rocks since the contact surface conforms to the shape of the irregular shaped object.

16 Claims, 7 Drawing Sheets

AMPHIBIOUS ROBOT MINE LOCATOR

BACKGROUND OF THE INVENTION

1. Field of the Invention

The present invention relates generally to an apparatus for locating man-made objects buried underground. More particularly, the present invention relates to an amphibious robot mine locator which is adapted for use in water-based and land-based environments to locate man objects such as mines.

2. Description of the Prior Art

Military landings on a beach in war time face significant hazards and obstructions such as buried mines and other anti-landing craft traps. This hazards and obstructions are either located in shallow water near the beach or on the beach. Presently, military personnel, such as the U.S. Navy's Seals are dispatched prior to the landings to clear the shallow water and beach of the obstructions and hazards. However, there are great personal risk associated with the removal of these obstructions and hazards. For example, a mine may detonate when the mine is being de-activated, thus seriously injuring the individual attempting to de-activate the mine. In addition, there may be enemy troops in the general area of the landing site which could lead to the death or capture of the military personnel attempting to clear the landing site of land mines and other hazards.

In the past the military would use, for example, metal detectors to detect the presence of mines. New technologies including ground-penetrating radar, infrared imaging, X-ray backscatter techniques and thermal neutron activation are available for detection of antipersonnel mines and the like. However, there is still a need to use military personnel to locate and de-activate the mines which places these individuals at great risk.

Accordingly, there is a need to develop an apparatus which eliminates or substantially reduces the risk to military personnel task with locating and de-activating mines and other hazards prior to a landing of troops from ocean-going vessels

SUMMARY OF THE INVENTION

The amphibious robot mine locator which constitutes the present invention overcomes some of the deficiencies of the prior art including those mentioned above in that it comprises a highly effective yet modestly priced apparatus which may be used in water-based and land-based environments to locate man objects such as mines. In a water-based environment a diver controls movement of the amphibious robot mine locator. In a land-based environment movement of the amphibious robot mine locator is via remote control. Amphibious robot mine locator includes a pair of oppositely turning and oppositely pitched propellers which propel the amphibious robot mine locator through the water with a ruder being provided to control the direction of movement of amphibious robot mine locator as it travels through the water. There is also a control panel which includes the controls for allowing the diver to steer amphibious robot mine locator and control the depth of mine locator.

When amphibious robot mine locator switches to a land-based mode of operation, the propellers function as wheels rotating in the same direction to move amphibious robot mine locator along a programmed path to continue its search for mines and other obstacles and hazards. The amphibious robot mine locator also has a pair of air operated pulsating blisters which allow for essentially frictionless movement across the surface of the ground irregardless of the shape of the surface. Each blister has a contact surface located on its underside which is fabricated from a material which is flexible and has a hard surface that will not scratch, such as Teflon. The flexibility of the contact surface of each blister allows the blister to travel over irregular shaped objects such as rocks since the contact surface conforms to the shape of the irregular shaped object.

DETAILED DESCRIPTION OF THE PREFERRED EMBODIMENT

Figure 1:
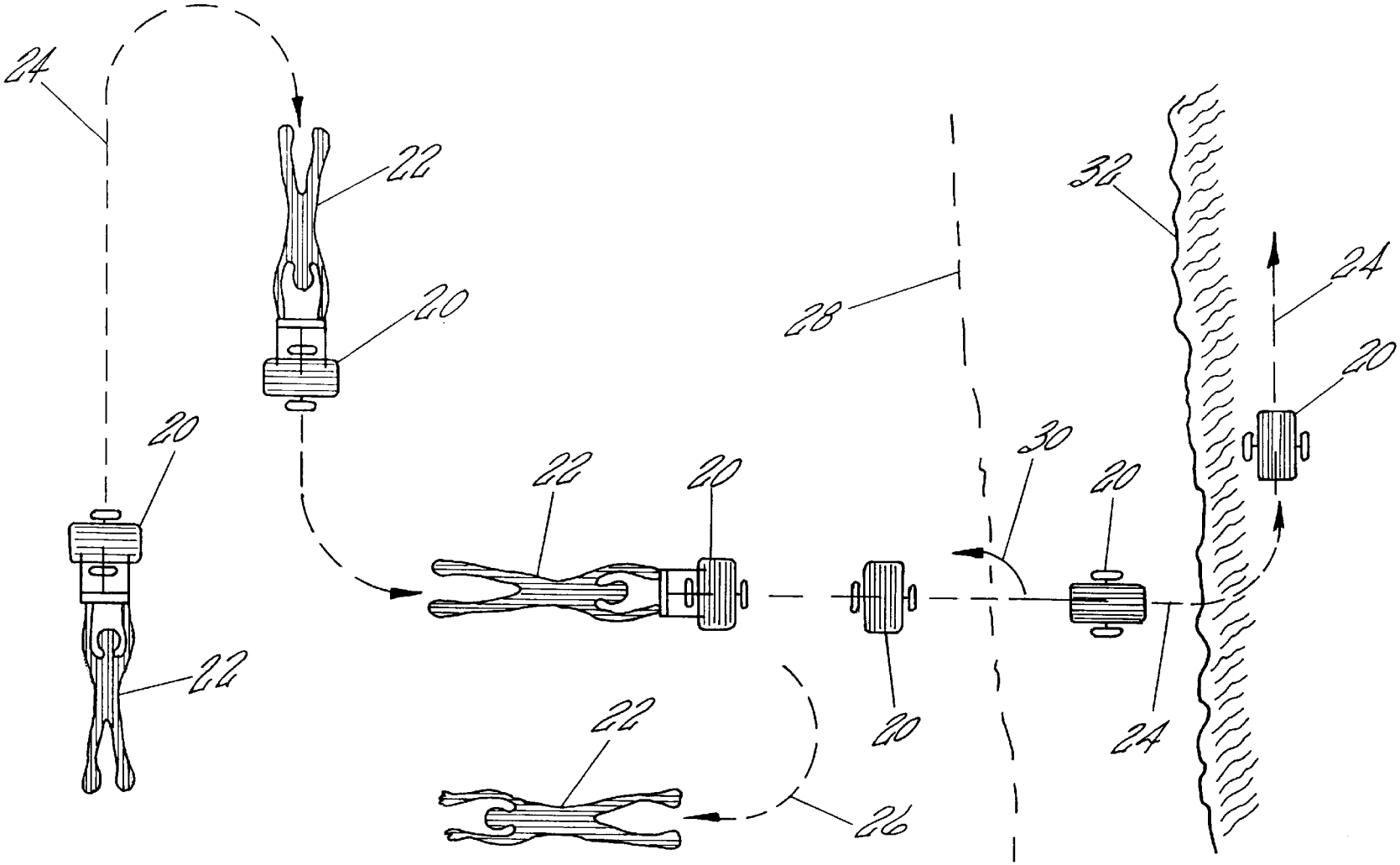
FIG. 1 is a plane view illustrating the operational modes of the amphibious robot mine locator which constitutes the present invention.

Referring first to FIG. 1, there is shown a diver 22 using an amphibious robot mine locator 20 to propel himself through the water along path 24 towards beach 32. Diver 22 follows path 24 near the ocean's bottom in an attempt to locate mines or other hazards and obstacles which would prevent landing craft from reaching beach 32 safely, that is without injury to the personnel on board the landing craft.

When diver 22 is near the shoreline, diver 22 separates from amphibious robot mine locator 20, heading away from beach 32 toward the ship from which amphibious robot mine locator 20 was launched as indicated by path 26. Amphibious robot mine locator 20 proceeds along path 24 until the propellers 38 and 42 (FIG. 2) of mine locator 20 engage the ocean floor 58 (FIG. 3) which occurs at a shallow water location 28. Amphibious robot mine locator 20 then rotates ninety degrees (as indicated by arrow 30) proceeding towards the shoreline along path 24. When amphibious robot mine locator 20 reaches beach 32, mine locator 20 makes a ninety degree turn proceeding along the beach 32 as it continues its search for mines or other hazards and obstacles to a landing by military personnel.

Referring to FIGS. 1, 2, 3 and 4, amphibious robot mine locator 20 includes a housing or main body 36 which has a rudder 56 pivotally mounted on a top portion of housing 36. Rudder 56 assist diver 22 to steer mine locator 20 along path 24 until diver 22 separates from mine locator 20 in the manner depicted in FIG. 1. Housing 36 of amphibious robot mine locator 20 also has a control panel 46 which includes the controls for allowing diver 22 to steer mine locator 20 and control the depth of mine locator 20.

Figures 2, 3, 4:
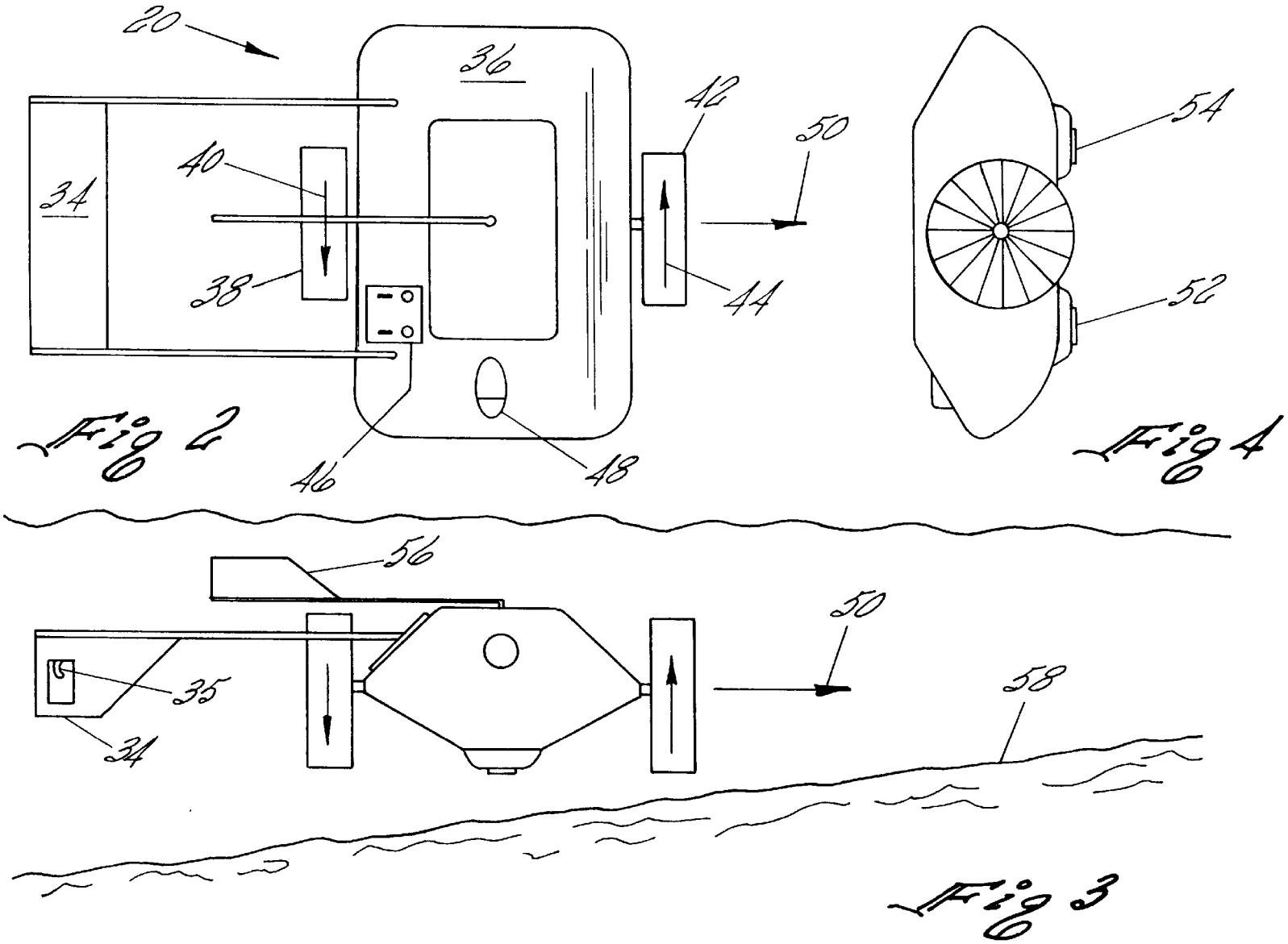
FIG. 2 is a top view of the amphibious robot mine locator illustrated in FIG. 1.
FIG. 3 is a side view of the amphibious robot mine locator illustrated in FIG. 1.
FIG. 4 front end view of the amphibious robot mine locator illustrated in FIG. 1.

Attached to the back side of housing 36 is a diver tow disconnect fin structure 34. Fin structure 34 includes a pair of triggers (one trigger 35 is illustrated in FIG. 3) which diver 22 pulls to detach fin structure 34 from housing 36 of amphibious robot mine locator 20 prior to diver 22 returning to his vessel. Detachment of fin structure 34 by diver 22 activates a heading hold mode of operation for mine locator 20, which results in rudder 56 of amphibious robot mine locator 20 holding mine locator 20 to a fixed heading along path 24 until mine locator 20 reaches beach 32.

Attached to the front of housing 36 is propeller 42, while the back side of housing 36 has propeller 38 attached thereto. When amphibious robot mine locator 20 is an underwater environment prior to mine locator 20 rotating ninety degrees, propeller 42 rotates in a clockwise direction as indicated by arrow 44, while propeller 38 rotates in a counter-clockwise direction as indicated by arrow 40. This results in a neutrally buoyant vehicle without torque being applied to amphibious robot mine locator 20.

When amphibious robot mine locator 20 arrives at location 28, propellers 38 and 42 engage the ocean floor 58 turning mine locator 20 ninety degrees in the counter clockwise direction until propellers 38 and 42 align with the direction of path 24. Propellers 38 and 42 now function as wheels rotating in the same direction clockwise direction to move mine locator 20 forward along path 24.

When propellers 38 and 42 engage the ocean floor 42, the resulting rotation of mine locator 20 by ninety degrees is sensed by a compass and yaw rate gyro (not shown) on board mine locator 20. This sensing of the ninety degree rotation of mine locator 20 initiates a change in direction for propeller 42 so that each propeller 38 and 42 is rotating in the same direction.

Housing 36 of amphibious robot mine locator 20 also has a video camera 48 mounted on board for recording video data as amphibious robot mine locator 20 travels along path 24. An infrared camera may also be mounted on board housing 36 of amphibious robot mine locator 20 for recording mine location and other data at night or under adverse weather conditions.

Housing 36 of amphibious robot mine locator 20 includes a GPS navigation system (not illustrated) which is activated when amphibious robot mine locator 20 is operating in a land based mode, that is amphibious robot mine locator 20 is on the beach 32. Amphibious robot mine locator 20 communicates with a remote station via an RF (radio frequency) link which includes a radio frequency antenna (not illustrated). The antenna allows for the transmission of mine and obstacle location data to the remote station as well for the transmission of coordinate information to amphibious robot mine locator 20 to direct mine locator 20 in a programmed search pattern as mine locator 20 continues along path 24 across beach 32.

Although not illustrated, amphibious robot mine locator 20 may use any of several technologies to locate mines buried underground including ground-penetrating radar, infrared imaging, X-ray backscatter techniques and the like.

Referring to FIGS. 1, 2, 5 and 6, housing 36 of amphibious robot mine locator 20 has a two-wheel independent drive system which includes propellers 38 and 42 which also function as wheels when amphibious robot mine locator 20 operates in a land based mode. Propellers 38 and 42 are directly connected to individual permanent magnet sealed motors (not illustrated) which are driven differentially to provide steering for amphibious robot mine locator 20.

Figure 6:
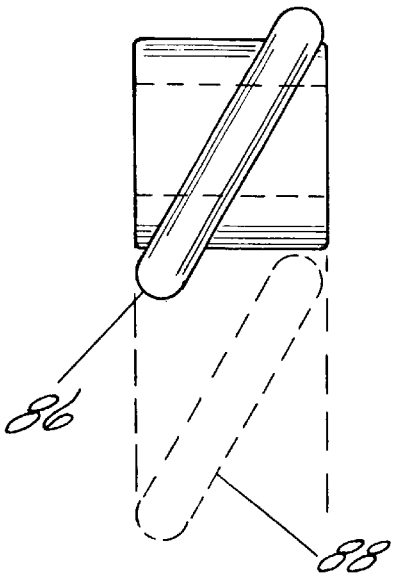
FIG. 6 is an end view of one of the blade tips of the propellers illustrated in FIG. 5.
Figure 5:
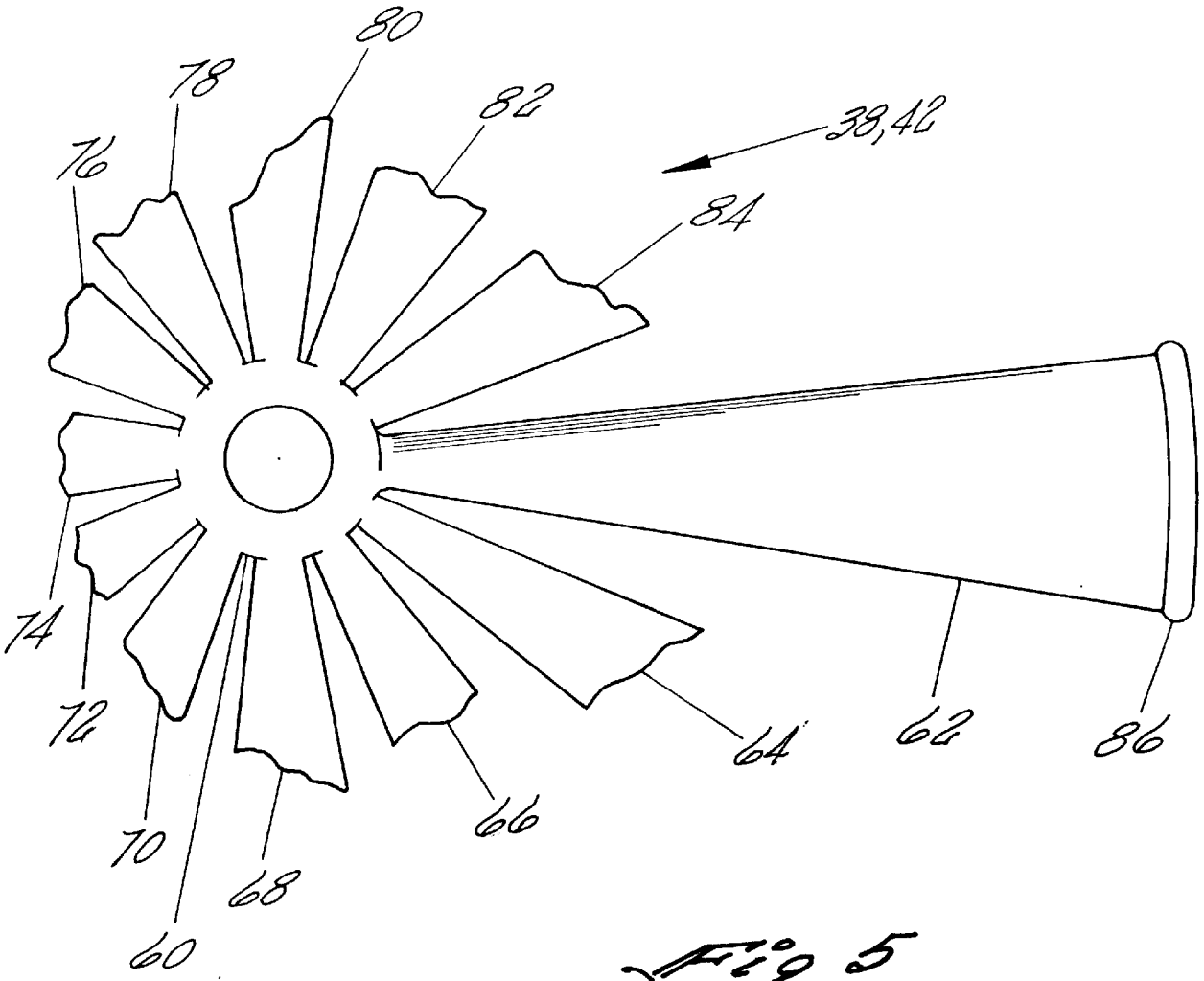
FIG. 5 is a detailed plane view of the propellers for the amphibious robot mine locator illustrated in FIG. 1.
Figure 7:
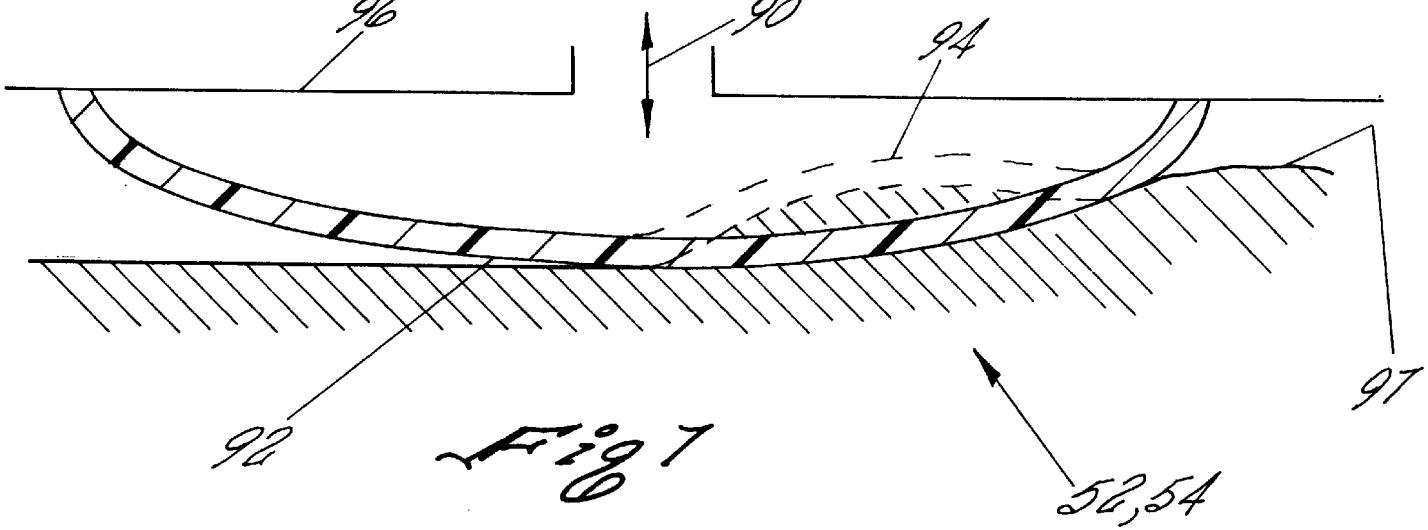
FIG. 7 is a view in section of one of the blisters for the amphibious robot mine locator illustrated in FIG. 1 when the blister is in contact with a rough surface.
Figure 8:
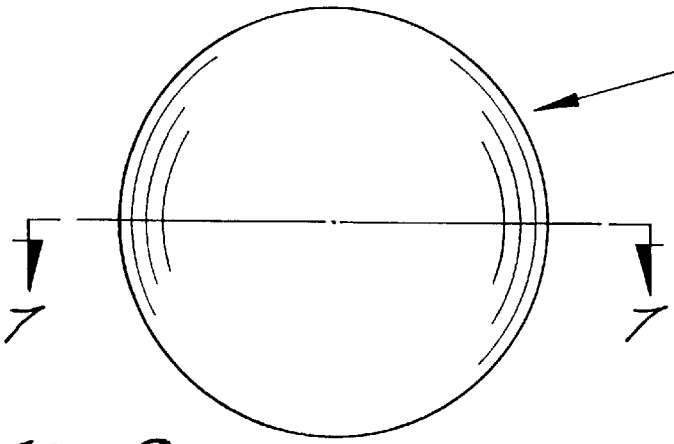
FIG. 8 is a bottom view of the blisters for the amphibious robot mine locator illustrated in FIG. 1 when the blister is in contact with a rough surface.
Figure 9:
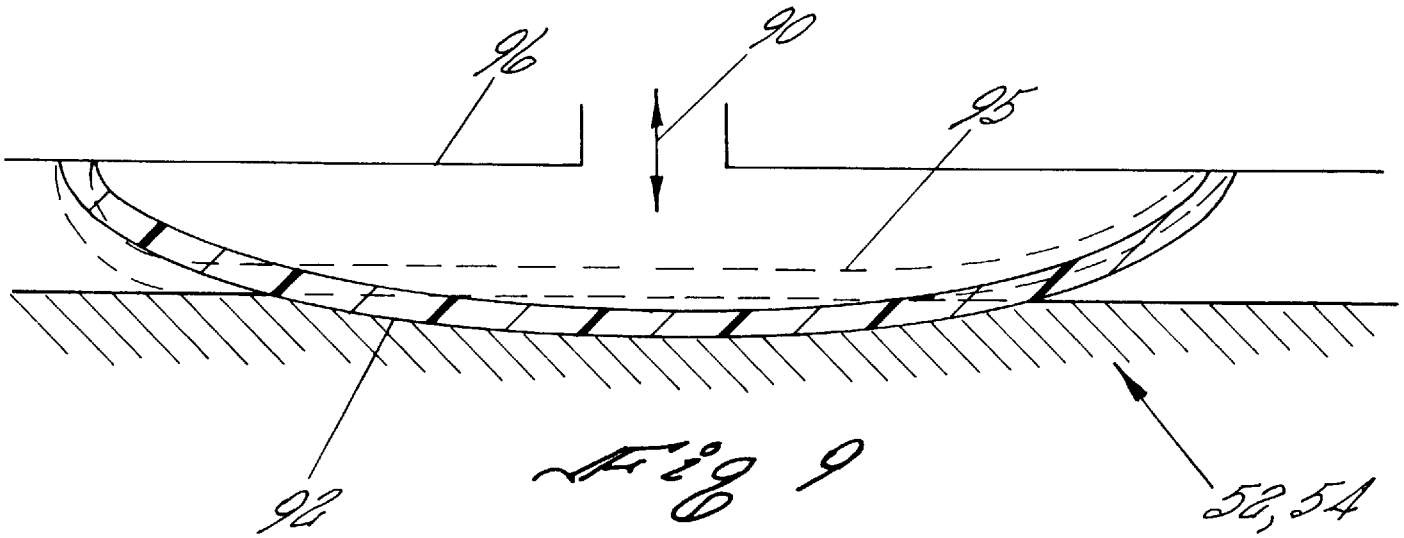
FIG. 9 is a view in section of one of the blisters for the amphibious robot mine locator illustrated in FIG. 1 when the blister is in contact with a smooth surface.
Figure 10:
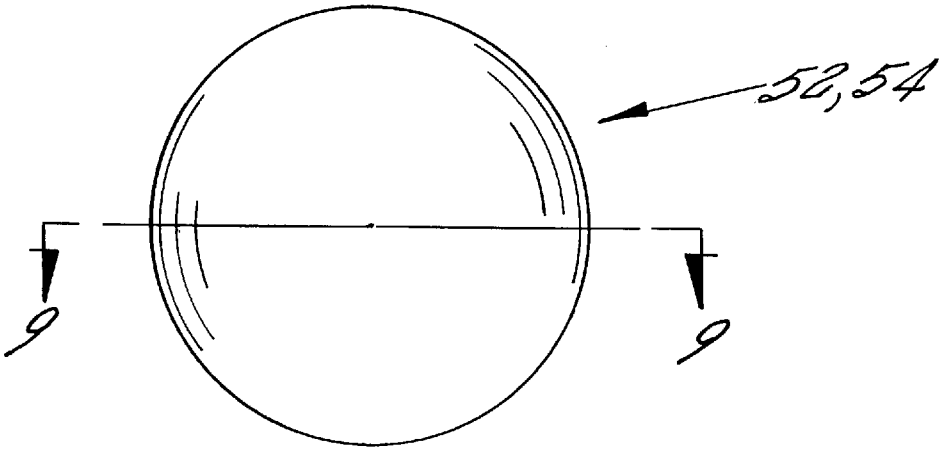
FIG. 10 is a bottom view of the blisters for the amphibious robot mine locator illustrated in FIG. 1 when the blister is in contact with a smooth surface.

As shown in FIGS. 5 and 6, each propeller 38 and 42 comprises a hub 60 which has attached thereto a plurality of blades 64, 66, 68, 70, 72, 74, 76, 78, 80, 82, and 84. Each blade 64, 66, 68, 70, 72, 74, 76, 78, 80, 82, and 84 is fabricated from a semi-flexible material such as hard rubber. This allows the blades of each propeller 38 and 42 to flex, which provides traction on a variety of surfaces such as ocean floor 58 and beach 32. When operating on land the flexible material used to fabricate the blades of propellers 38 and 42 allows the blades to adapt to rocks and also grip softer surfaces such as mud and sand. Attached to the end of each blade 64, 66, 68, 70, 72, 74, 76, 78, 80, 82, and 84 is a blade tip 86 which enlarges that portion of the blade which is in contact with ocean floor 58 or the sand of beach 32. The enlarged blade tips, in turn, increase the load bearing surface when amphibious robot mine locator 20 is operating on soft soils such as sand.

Figure 11:
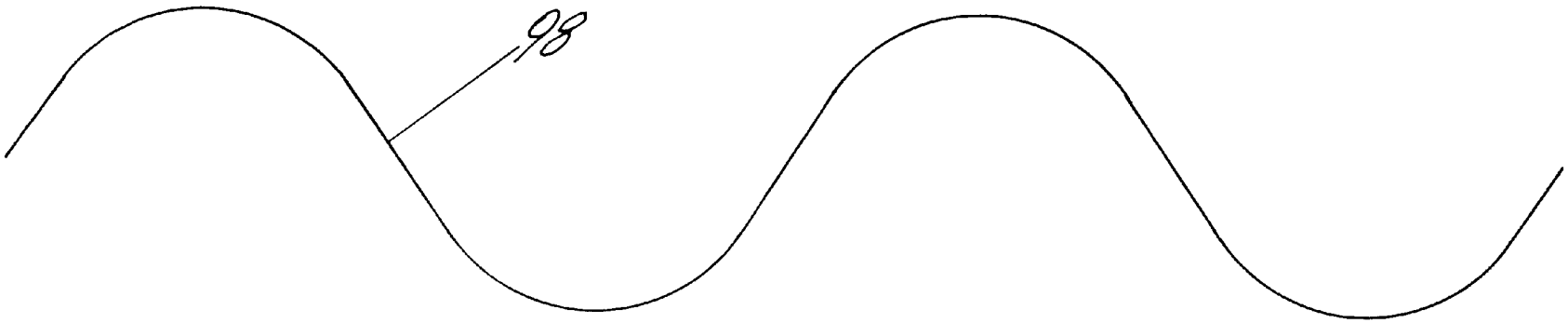
FIG. 11 is a waveform illustrating the natural pitching frequency of the amphibious robot mine locator of FIG. 1.
Figure 12:
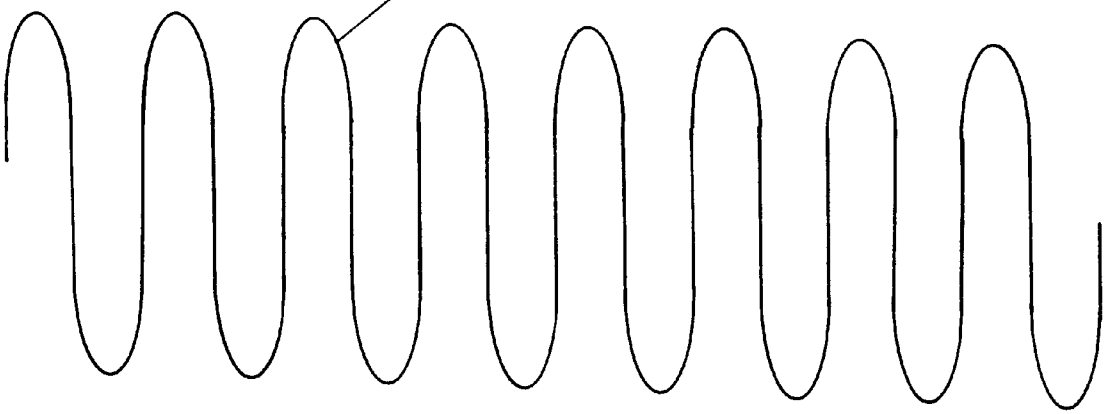
FIG. 12 is a waveform illustrating the impulse frequency of the blisters for the amphibious robot mine locator of FIG. 1.

Referring to FIGS. 1, 4 and 7–10, housing 36 of amphibious robot mine locator 20 has a pair of flexible air inflated blisters 52 and 54 which are positioned on the underside of housing 36. The blisters 52 and 54 function as caster wheels allowing mine locator 20 to turn in different directions along its programmed path 24 when amphibious robot mine locator 20 is operating in a land based mode. Each blisters 52 and 54 has a contact surface 92 which is fabricated from a material which is flexible and has a hard surface that will not scratch, such as TEFLON. The flexibility of surface 92 allows the blister to travel over irregular shaped objects such as rocks since contact surface 92 which is flexible conforms to the shape of the irregular shaped object (as indicated the reference numeral 95). The pulsation of the contact surface of each blister 52 and 54 allows for an essentially frictionless ride over the surface of beach 32. Blisters 52 and 54 are pulsed by an oscillating electromagnetic piston (not illustrated) which use air to drive blisters 52 and 54 (as indicated generally by reference 90). The blisters are driven or pulsed 180 degrees out of phase from each other at a frequency within a frequency range which is from about ten hertz to about twenty hertz. As shown in FIGS. 11 and 12, the impulse frequency 100 for blisters 52 and 54 generally has a frequency several orders of magnitude greater than the natural pitching frequency 98 of amphibious robot mine locator 20. The frequency of waveform 100 may be, for example, may be 8–10 times greater than the frequency of waveform 98.

Figure 13:
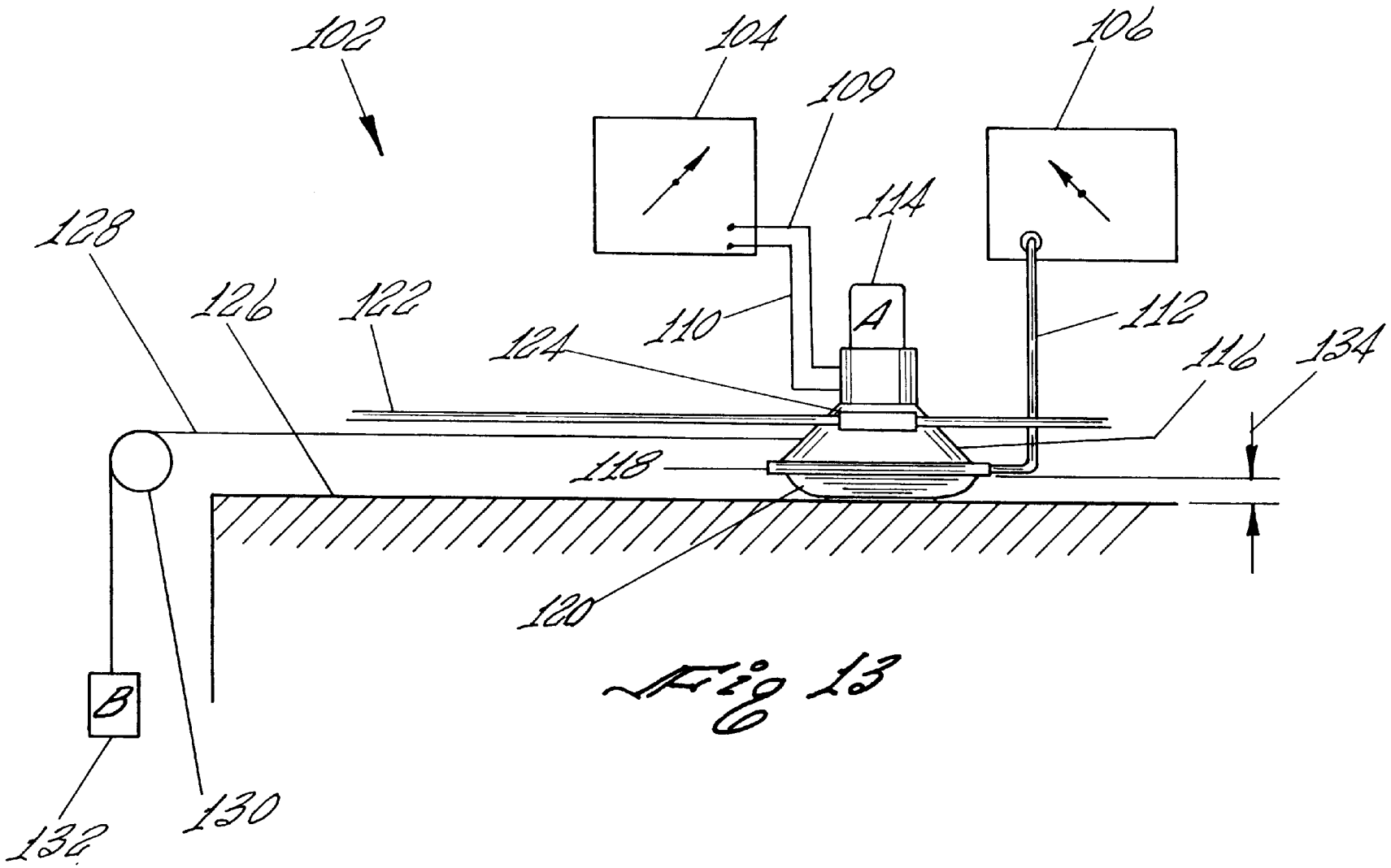
FIG. 13 illustrates a test configuration for determining the design parameters for the blisters of the amphibious robot mine locator of FIG. 1.

Referring now to FIG. 13, there is shown a simple test setup 102 for determining the design parameters for the blisters 52 and 54 of the amphibious robot mine locator 20. Test setup 102 includes a table 126 which has test blister 120 engaging its top surface. A dynamic speaker 116 is connected to the test blister 120 via a clamp ring 118. A variable air pressure supply 106 is connected to dynamic speaker 116 via a pipe 112. A variable frequency power source 104 is connected to dynamic speaker 116 via wires 108 and 110. The test setup includes a weight 144 which is located on top of dynamic speaker 116 and a flexible wire 128 which is used to connect to dynamic speaker 116. A pulley 130 engages flexible wire 128 allowing weight 132 to fall moving along the top surface of table 126. A guide 122 is provided to guide blister 120 along the top surface of table 126. Guide 122 is engaged by a guide member 124 attached to dynamic speaker 116. The combination of variable frequency power source 104 and variable air pressure supply 106 along with dynamic speaker 116 generate the pulsating air required to test blister 120 as blister travels across the top surface of table 126. The results of these test may be used by the designer to optimize the performance of blister 120.

From the foregoing, it is readily apparent that the present invention comprises a new, unique, and exceedingly amphibious robot mine locator, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. An amphibious robot mine locator for detecting mines in an underwater environment and a ground-based environment, said amphibious robot mine locator being adapted for use by a diver when said amphibious robot mine locator is operating in said underwater environment, said amphibious robot mine locator comprising:

a main body;

drive means for propelling said main body through said underwater environment and for propelling said main body along a programmed path when said amphibious robot mine locator is operating on said ground-based environment;

first steering means for steering said main body when said amphibious robot mine locator is operating in said underwater environment;

second steering means for steering said main body along said programmed path and for providing substantially frictionless movement over surface having irregular shaped objects when said amphibious robot mine locator is operating on said ground-based environment; and monitoring means mounted on said main body for recording image data indicating a location each of said mines located by said amphibious robot mine locator.

2. The amphibious robot mine locator of claim 1 further comprising a diver tow disconnect fin structure attached to said main body, said diver tow disconnect fin structure being adapted to tow said diver when said amphibious robot mine locator is operating in said underwater environment and to disconnect from said main body when said amphibious robot mine locator is operating on said ground-based environment.

3. The amphibious robot mine locator of claim 1 wherein said drive means comprises a pair of propellers, a first of said propellers being rotatably mounted on one side of said main body and a second of said propellers being rotatably mounted on an opposite side of said main body.

4. The amphibious robot mine locator of claim 1 wherein said first steering means comprises a rudder pivotally mounted on a top portion of said main body.

5. The amphibious robot mine locator of claim 1 wherein said second steering means comprises a pair of air operated pulsating blisters mounted on an underside of said main body, said pair of air operated pulsating blisters being pulsed 180 degrees out of phase from each other at a frequency which is within a frequency range of from about ten hertz to about twenty hertz.

6. The amphibious robot mine locator of claim 1 wherein monitoring means comprises a video camera.

7. The amphibious robot mine locator of claim 1 wherein monitoring means comprises an infrared camera.

8. An amphibious robot mine locator for detecting mines in an underwater environment and a ground-based environment, said amphibious robot mine locator being adapted for use by a diver when said amphibious robot mine locator is operating in said underwater environment, said amphibious robot mine locator comprising:

a main body;

a pair of propellers for propelling said main body through said underwater environment and for propelling said main body along a programmed path when said amphibious robot mine locator is operating on said ground-based environment, a first of said propellers being rotatably mounted on one side of said main body and a second of said propellers being rotatably mounted on an opposite side of said main body;

a ruder pivotally mounted on a top portion of said main body for steering said main body when said amphibious robot mine locator is operating in said underwater environment;

a pair of air operated pulsating blisters mounted on an underside of said main body for steering said main body along said programmed path and for providing substantially frictionless movement over surface having irregular shaped objects when said amphibious robot mine locator is operating on said ground-based environment; and a camera mounted on said main body for recording image data indicating a location each of said mines located by said amphibious robot mine locator.

9. The amphibious robot mine locator of claim 8 further comprising a diver tow disconnect fin structure attached to said main body, said diver tow disconnect fin structure being adapted to tow said diver when said amphibious robot mine locator is operating in said underwater environment and to disconnect from said main body when said amphibious robot mine locator is operating on said ground-based environment.

10. The amphibious robot mine locator of claim 8 wherein camera comprises a video camera.

11. The amphibious robot mine locator of claim 8 wherein camera comprises an infrared camera.

12. An amphibious robot mine locator for detecting mines in an underwater environment and a ground-based environment, said amphibious robot mine locator being adapted for use by a diver when said amphibious robot mine locator is operating in said underwater environment, said amphibious robot mine locator comprising:

a main body;

a pair of propellers for propelling said main body through said underwater environment and for propelling said main body along a programmed path when said amphibious robot mine locator is operating on said ground-based environment, a first of said propellers being rotatably mounted on one side of said main body and a second of said propellers being rotatably mounted on an opposite side of said main body;

a ruder pivotally mounted on a top portion of said main body for steering said main body when said amphibious robot mine locator is operating in said underwater environment;

a pair of air operated pulsating blisters mounted on an underside of said main body for steering said main body along said programmed path and for providing substantially frictionless movement over surface having irregular shaped objects when said amphibious robot mine locator is operating on said ground-based environment;

each of said air operated pulsating blisters having a contact surface which is fabricated from a flexible scratch resistant material, the flexibility of said contact surface allowing said pair of air operated pulsating blisters to travel over said irregular shaped objects, said pair of air operated pulsating blisters being pulsed 180 degrees out of phase from each other at a frequency which is within a frequency range of from about ten hertz to about twenty hertz; and a camera mounted on said main body for recording image data indicating a location each of said mines located by said amphibious robot mine locator.

13. The amphibious robot mine locator of claim 12 further comprising a diver tow disconnect fin structure attached to said main body, said diver tow disconnect fin structure being adapted to tow said diver when said amphibious robot mine locator is operating in said underwater environment and to disconnect from said main body when said amphibious robot mine locator is operating on said ground-based environment.

14. The amphibious robot mine locator of claim 12 wherein said flexible scratch resistant material comprises TEFLON.

15. The amphibious robot mine locator of claim 12 wherein camera comprises a video camera.

16. The amphibious robot mine locator of claim 12 wherein camera comprises an infrared camera.

* * * * *